US011602779B2

(12) United States Patent
Gohr

(10) Patent No.: US 11,602,779 B2
(45) Date of Patent: Mar. 14, 2023

(54) DEVICE FOR CONTROLLING A STRETCH-REDUCING MILL

(71) Applicant: SMS group GmbH, Düsseldorf (DE)

(72) Inventor: Alexander Gohr, Mönchengladbach (DE)

(73) Assignee: SMS group GmbH, Düsseldorf (DE)

( * ) Notice: Subject to any disclaimer, the term of this patent is extended or adjusted under 35 U.S.C. 154(b) by 25 days.

(21) Appl. No.: 15/733,116

(22) PCT Filed: Nov. 20, 2018

(86) PCT No.: PCT/EP2018/081896
§ 371 (c)(1),
(2) Date: Aug. 10, 2020

(87) PCT Pub. No.: WO2019/101727
PCT Pub. Date: May 31, 2019

(65) Prior Publication Data

US 2020/0391263 A1 Dec. 17, 2020

(30) Foreign Application Priority Data

Nov. 21, 2017 (DE) ..... 10 2017 220 750.7

(51) Int. Cl.
*B21B 37/78* (2006.01)
*B21B 17/14* (2006.01)

(52) U.S. Cl.
CPC ..... *B21B 37/78* (2013.01); *B21B 17/14* (2013.01); *B21B 2261/10* (2013.01)

(58) Field of Classification Search
CPC ..... B21B 17/14; B21B 35/025; B21B 37/16; B21B 37/165; B21B 37/78; B21B 38/04; B21B 2261/04; B21B 2261/10
USPC ..... 72/12.8
See application file for complete search history.

(56) References Cited

U.S. PATENT DOCUMENTS

| | | | | |
|---|---|---|---|---|
| 4,002,048 A | 1/1977 | Pozsgay | | |
| 4,086,800 A | 5/1978 | Demny et al. | | |
| 4,323,971 A * | 4/1982 | Moltner | B21B 37/78 | 72/11.8 |
| 4,430,875 A | 2/1984 | Demny et al. | | |
| 6,526,792 B1 * | 3/2003 | Pehle | B21B 37/78 | 72/10.3 |

FOREIGN PATENT DOCUMENTS

| | | | | |
|---|---|---|---|---|
| CN | 1909987 A | | 2/2007 | |
| CN | 101274335 A | | 10/2008 | |
| CN | 204523791 U | | 8/2015 | |
| CN | 206253457 U | | 6/2017 | |
| DE | 1602181 A1 | | 2/1970 | |
| DE | 1962792 A1 | | 6/1971 | |
| DE | 2557707 A1 | | 6/1977 | |
| DE | 2645497 A1 | | 6/1977 | |
| DE | 3028211 A1 | | 2/1982 | |
| DE | 3819571 | * | 6/1988 | |
| DE | 3819571 A1 | | 12/1989 | |
| DE | 19840864 C1 | | 7/1999 | |
| DE | 10201717 | * | 4/2003 | |
| DE | 10201717 C1 | * | 4/2003 | B21B 37/46 |
| DE | 10157742 C1 | | 6/2003 | |
| DE | 102015118065 A1 | | 4/2017 | |
| JP | S60021114 | * | 2/1985 | |
| JP | S62124007 | * | 6/1987 | |
| JP | H07246414 A | | 9/1995 | |
| JP | 2004017066 A | | 1/2004 | |
| RU | 2224607 C2 | | 2/2004 | |
| SU | 715159 A1 | | 2/1980 | |

OTHER PUBLICATIONS

DE10201717 (Year: 2003).*
Speed measurement and acceleration/deceleration control of a stepper motor based on a programmable logic controller, Li DaCheng, etalia (Abstract), Journal of Beijing University of Chemical Technology (Natural Science) vol. 38, No. 4, 2011 (Year: 2011).*
DE3819571A1 USPTO translation (Year: 1988).*
JPS60021114 Oota, et alia (Feb. 2, 1985) (Year: 1985).*
JPS62124007 Okumura,et alia (Jun. 5, 1987) (Year: 1987).*

* cited by examiner

*Primary Examiner* — Jimmy T Nguyen
*Assistant Examiner* — Fred C Hammers
(74) *Attorney, Agent, or Firm* — Smartpat PLC

(57) ABSTRACT

The disclosure relates to a method for controlling a stretch-reducing mill. Tube ends of stretched tubes are optimized by controlling one or more motors of the stretch-reducing mill. The method includes at least one outlet-side wall thickness measurement and an automatic adjustment of the value of a speed change of the motors to the tube wall thickness profile. The progression of the speed changes over time of individual or all motors is also automatically adjusted on the basis of the tube wall thickness measured values.

5 Claims, 1 Drawing Sheet

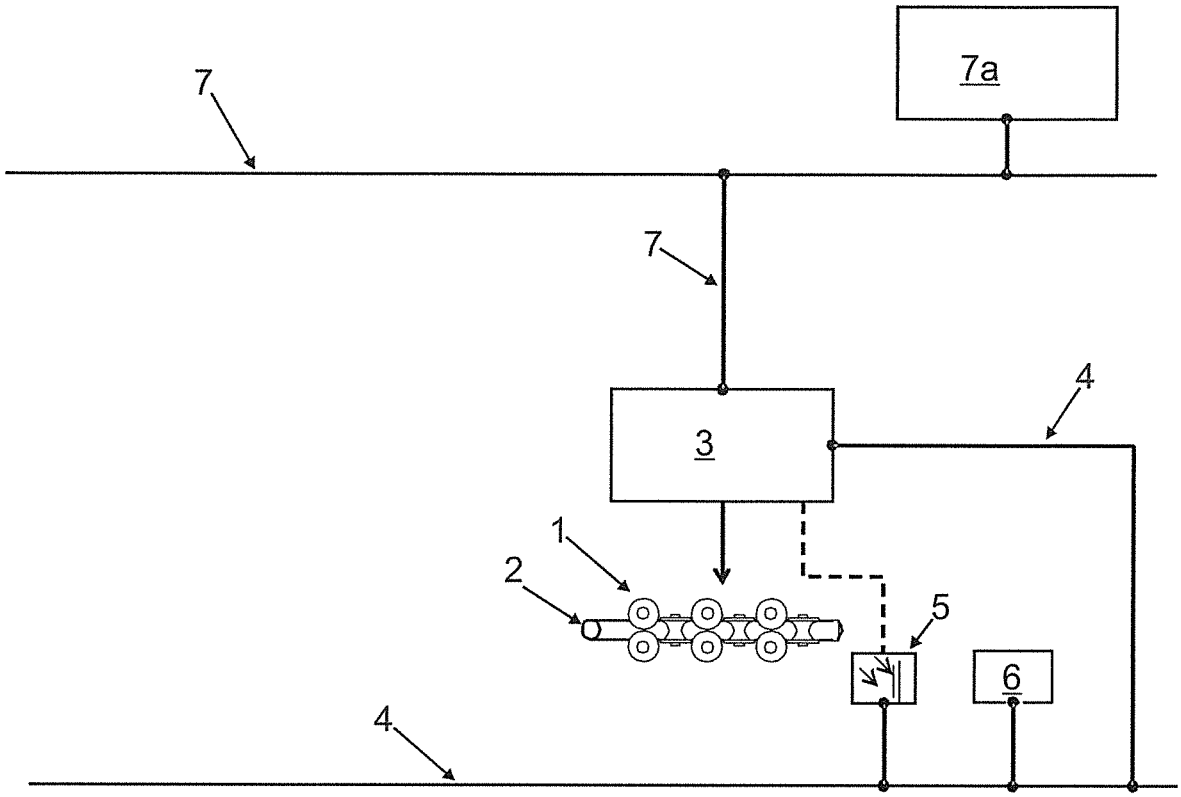
7a
7
7
4
3
1
2
5
6
4

DEVICE FOR CONTROLLING A STRETCH-REDUCING MILL

TECHNICAL FIELD

The disclosure relates to a method for controlling a stretch-reducing mill.

BACKGROUND

When stretch-reducing tubes, the process causes the tube wall thickness to thicken or bulge at the tube ends compared to the middle section of the tube. This is due to the fact that, at the front or rear tube end, the longitudinal rolling tension otherwise achieved in the central tube part is not reached as a consequence of the lack of engagement of the roll stands located in the rolled material, either upstream or downstream in the conveying direction. The tube sections therefore thickened beyond the permissible wall thickness tolerance constitute loss of output and must be cut off.

In addition, in particular in stretch-reducing mills in seamless tube plants, the main tubes or shells used may have upset wall thicknesses at the ends, for example as the result of tool wear in the upstream equipment. These upsets of the main tubes causes an additional thickening of the finished tube ends.

Different methods have been devised to reduce end losses. End loss control through dynamically changing the motor or roll speeds as the tube ends pass through the mill has achieved practical and widespread significance. In this process, the speed ratio between the roll passes nearest to the tube end is increased and thus an increased rolling tension is applied.

In principle, such systems have been known for a long time, for example by DE 1 602 181 A or DE 1 962 792 A.

Numerous embodiments have been proposed, for example by DE 25 57 707 A1, DE 198 40 864 A1, DE 26 45 497 A1 or DE 30 28 211 A1. However, all these sources do not address the problem of the specific setting of the change in the speed.

The particular challenge is, on the one hand, to bring about the changes in the speed mentioned above on a timely basis, as otherwise they have no effect on the end thickening. On the other hand, the strength of the change in the speed and the transition to stationary speeds must be precisely coordinated, since, otherwise, the sections adjacent to the tube ends may impermissibly fall below the target wall thickness. The situation is further complicated by the fact that the speed curves of up to 32 drive motors can be set. It is not possible to determine in advance theoretical speed curves that achieve the best possible shortening of the thickened ends without further adjustment. However, for the operating teams, manually setting the speed curves is a difficult and time-consuming procedure.

This problem has been known for a long time and has led to further proposals for possible automation. For example, the aforementioned DE 1 962 792 A1 already teaches the application of tapping detection on the one hand by sensors in front of the SRM and on the other hand by detecting the change in motor speed as a consequence of the change in load when the tube enters or exits a rolling pass. This enables the position of the tube ends to be better tracked and a partially automatic adaptation of the control parameters to be achieved. However, this form of tube tracking in the SRM is not suitable for mills in which groups of rolling passes are driven by common motors. Moreover, the development of modern frequency-controlled asynchronous motors has led to the fact that the speed drops as a consequence of a load change are minimal and can barely be detected by a tube end controller.

Solutions have also been proposed in which additional sensors, such as light barriers or photocells within the SRM, are to take over the detection of the current position of the front or rear tube end and thus trigger the use of the speed controller. However, due to the unavoidable and disadvantageous environmental influences in the SRM, such as spray water, steam or dust, such systems are not sustainably reliable.

JP H07246414 A describes an automatic adjustment of the motor speeds on the basis of tube measurement data. However, the times of use and the duration of the effect are not adjusted. However, both have a high influence on the control result. In addition, the influence of the incoming tube is not taken into account. Likewise, a summary of several rolling operations to minimize the influence of measurement errors or outliers is not stated.

It is disadvantageous in the prior art that mill operators usually have to make correction settings on the CEC in practical operation or at least at the beginning of a rolling campaign. If necessary, adjustments may also have to be made within a rolling campaign, for example as a consequence of tool wear.

SUMMARY

It is the object of the disclosure to specify a method of controlling a stretch-reducing mill, with which a loss of output due to thickened tube ends is reduced.

This object is achieved by the method as claimed. By adjusting the speeds during the passage of a tube, it is possible to achieve a particularly precise influence on the resulting course of the wall thicknesses in the area of the tube ends.

In an automatic mode, a CEC independently monitors and evaluates the wall thickness results achieved at the tube ends and readjusts the strength and progression of the change in the speed over time at the tube ends for the following tubes.

Additional advantages of the invention are that it reduces the workload of the mill operators. Optimum CEC settings are found more quickly and are better maintained during a rolling campaign.

In the case of a preferred embodiment, the progression of speeds over time is characterized by the start time of the change in the speed and the end point of the change in the speed. Thereby, it may be particularly advantageously provided that the progression over time is characterized by a start time or end time and a rate of change.

For more precise optimization, it may be provided that the evaluation of the wall thickness curve is carried out on at least three sections of the wall thickness profile.

It may be generally advantageous to provide that the evaluation of the wall thickness curve is made from several target values.

In the case of a particularly preferred embodiment, it may be provided that the method is combined with a wall thickness control system for automatically controlling the wall thicknesses outside the thickened ends.

In the case of a controller for a stretch-reducing mill, the wall thickness curves at the ends can be examined for cyclical patterns, wherein such patterns are taken into account in the control of the motors.

In the case of a possible additional embodiment, a measurement of an incoming shell wall thickness profile can be carried out, wherein the values and the progression of the speed changes over time of the tube end control are adjusted to shell wall thickness measurements. In this manner, the shaping of a shell into a tube as an end product is engaged at a very early stage in order to improve the tube end diameter.

In a preferential additional embodiment, the wall thickness curves at the shell ends can be examined for cyclical patterns, and such patterns can also be taken into account.

In doing so, it may also be preferably provided that the method is combined with a wall thickness control system to automatically control the wall thickness outside the thickened ends.

An additional measure to improve the disclosure consists of an automatic tapping detection.

An additional measure improving the disclosure consists of a consideration of the actual wall thickness curves at the ends of the incoming main tubes.

An additional measure improving the disclosure consists of a specification of target or ideal shapes of the tube ends of each dimension.

An additional measure to improve the disclosure consists of the use of pattern recognition algorithms to evaluate the wall thickness curve of each tube end.

An additional measure to improve the disclosure consists of a simulation to pre-calculate the effect of a change of setting.

An additional measure to improve the disclosure consists of the iteration of the CEC setting over several shells to find a stable optimum.

In the following, a preferred exemplary embodiment of the invention is described and explained in more detail on the basis of the attached drawings.

BRIEF DESCRIPTION OF THE DRAWINGS

FIG. 1 shows a schematic illustration of a stretch-reducing mill with its control system.

DETAILED DESCRIPTION

A stretch-reducing mill comprises several rolls in roll stands 1, which are driven by controllable motors. Thereby, the stretch reduction of a rolled material 2 is achieved by means of a selective control of the motors with different speeds, such that the rolled material is put under tensile stress between the rolls.

The motors are supplied with electrical energy via a programmable logic controller (PLC) 3. The PLC 3 takes over the query and/or calculation of the speeds of the motors during the rolling process.

The PLC 3 is connected via a network 4 in the form of a Fieldbus system with sensors 5, 6, such that measured values flow directly into the PLC. The sensors 5 are exemplary position sensors, for example in the form of light barriers. The sensors 6 determine further measured values for monitoring the rolling process, in particular diameter, wall thickness and temperature of the rolled material.

The PLC 3 can also communicate with a process control computer 7*a* at a process control level via a network 7 that is not real-time capable.

On a stretch-reducing mill described as an example above, a method in accordance with the disclosure for controlling a stretch-reducing mill can be carried out. In this process, tube ends of stretched tubes are optimized by controlling one or more motors of the stretch-reducing mill.

At least one outlet-side wall thickness measurement is carried out by the sensors 6 and an automatic adjustment of the value of a speed change of the motors to the measured tube wall thickness profile is performed. The progression of the speed changes over time of individual or all motors is also automatically adjusted on the basis of the measured tube wall thickness values.

The progression of the speeds over time is characterized by the start time of the speed change and the end point of the speed change. In particular, the progression over time is also characterized by a rate of change of the speeds.

An evaluation of the wall thickness curve is carried out on at least three sections of the wall thickness profile.

In addition, the evaluation of the wall thickness curve is made from several target values.

The method for controlling the tube end thickness is combined with a wall thickness control system for the automatic control of the wall thickness outside the thickened ends.

The measured values by the sensors 6 are analyzed by means of programs, wherein the wall thickness curves at the ends are examined for cyclic patterns and such patterns are taken into account in the control of the motors.

In addition to a measurement of the wall thicknesses of the (partially) stretched tubes, a measurement of an incoming shell wall thickness profile is carried out, wherein the values and the progression of the speed changes over time of the tube end control are adjusted to shell wall thickness measurements.

Thereby, the wall thickness curves at the shell ends are examined for cyclical patterns and such patterns are taken into account.

As a whole, the method is combined with a wall thickness control system for the automatic control of wall thicknesses outside the thickened ends.

LIST OF REFERENCE SIGNS

1 Roll stand with rolls and motors
2 Rolled material
3 PLC=programmable logic control
4 Bus system, Fieldbus
5 Sensors, Position sensors
6 Sensors for diameter, wall thickness, temperature, etc.
7 Network at process control level
7*a* Process control computer

The invention claimed is:

1. A method for controlling a stretch-reducing mill in which tube ends of stretched tubes are optimized by controlling motors of the stretch-reducing mill by a programmable logic controller, comprising:

measuring outlet-side wall thicknesses of the stretched tubes by a sensor that is operatively connected to the programmable logic controller; and automatically adjusting speed changes of the motors while stretching a following tube based on a tube wall thickness profile of an earlier stretched tube, wherein the programmable logic controller calculates, based on the measured wall thicknesses of the earlier stretched tube, for each of the speed changes of individual ones of the motors a start time of the speed change, an end time of the speed change, and a rate of speed change.

2. The method according to claim 1, wherein the method is combined with a wall thickness control system for automatically controlling wall thicknesses outside of thickened ends.

3. The method according to claim 1, wherein wall thickness measurements along ends of the stretched tubes are examined for cyclic patterns and wherein the cyclic patterns are considered in controlling the motors.

4. The method according to claim 1, wherein a measurement of an incoming shell wall thickness profile is carried out, and wherein the speed changes are adjusted to the measurement of the incoming shell wall thickness.

5. The method according to claim 4, wherein the method is combined with a wall thickness control system for automatically controlling a wall thicknesses outside thickened ends.

* * * * *